US006349024B1

(12) United States Patent
Gundlach

(10) Patent No.: US 6,349,024 B1
(45) Date of Patent: Feb. 19, 2002

(54) DC BIASED AC CORONA CHARGING

(75) Inventor: Robert W. Gundlach, Victor, NY (US)

(73) Assignee: Aetas Technology Incorporated, Irvine, CA (US)

( * ) Notice: Subject to any disclaimer, the term of this patent is extended or adjusted under 35 U.S.C. 154(b) by 0 days.

(21) Appl. No.: 09/420,395

(22) Filed: Oct. 18, 1999

(51) Int. Cl.[7] ..... H05F 3/00
(52) U.S. Cl. ..... 361/225; 361/235; 250/324
(58) Field of Search ..... 361/225–229, 361/235; 250/324–326

(56) References Cited

U.S. PATENT DOCUMENTS

| | | | | | |
|---|---|---|---|---|---|
| 2,777,957 | A | | 1/1957 | Walkup | |
| 2,778,946 | A | | 1/1957 | Mayo | |
| 2,965,481 | A | | 12/1960 | Gundlach | |
| 3,076,092 | A | | 1/1963 | Mott | |
| 3,147,415 | A | | 9/1964 | Oliphant | |
| 3,492,476 | A | | 1/1970 | Germanos | |
| 4,574,326 | A | * | 3/1986 | Myochin et al. | 361/229 |
| 4,728,880 | A | | 3/1988 | Walgrove | |
| 4,783,716 | A | * | 11/1988 | Nagase et al. | 361/225 |
| 5,144,521 | A | * | 9/1992 | Tagoku et al. | 361/225 |
| 5,742,871 | A | | 4/1998 | May et al. | |
| 5,890,035 | A | | 3/1999 | Kumar et al. | |
| 5,907,155 | A | * | 5/1999 | Skinner | 250/326 |
| 5,907,753 | A | | 5/1999 | Kumar et al. | |
| 6,025,594 | A | * | 2/2000 | Bryce et al. | 250/324 |

* cited by examiner

*Primary Examiner*—Michael J. Sherry
(74) *Attorney, Agent, or Firm*—BakerBotts, LLP

(57) ABSTRACT

In one corona charging arrangement described in the specification, a coronode supplied with AC voltage is contacted by an insulating member in the form of a mesh of insulating filaments or an imperforate dielectric insulating member or filaments wound around an insulating member and retaining the coronode in fixed position with respect to the insulating member. In another embodiment, the insulating member is a layer of dielectric material coated on a coronode in the form of a corona wire and a capacitor is connected between the AC voltage source and the coronode. By providing an insulating structure for a coronode and applying a DC biased AC voltage to the coronode, improved charging efficiency with respect to prior art arrangements is obtained while reducing generation of ozone and nitrates and increased charging currents are obtained to provide high charging rates without arcing.

25 Claims, 9 Drawing Sheets

DC BIASED AC CORONA CHARGING

BACKGROUND OF THE INVENTION

This invention relates to corona charging arrangements and, more particularly, to a DC biased AC corona charging arrangements.

The use of a corona discharge device has been conventional in xerographic copiers since the inception of commercial xerography. A corona discharge device, or "coronode", can be a fine wire or an array of points which ionizes air molecules when a high voltage is applied. Originally, a DC voltage of 6 to 7 thousand volts was applied to a coronode in xerographic copiers to ionize the adjacent air molecules causing electric charges to be repelled from the coronode and attracted to an adjacent lower potential surface such as that of the photoreceptor to be charged. In the absence of control, however, such charging arrangements tend to deposit excessive and nonuniform charges on the adjacent surface.

In order to control the application of charges to the adjacent surface so as to provide a uniform charge distribution and avoid overcharging, a conductive screen has been interposed between a coronode and the surface to be charged. Such screened corona discharge devices are referred to as "scorotrons". Typical scorotron arrangements are described in the Walkup U.S. Pat. No. 2,777,957 and the Mayo U.S. Pat. No. 2,778,946. Early scorotrons, however, reduced the charging efficiency of the corona device to only about 3%. That is, only about three out of every one hundred ions generated at the coronode reached the surface to be charged. They also exhibited poor charging uniformity control sometimes allowing the surface to be charged to a voltage exceeding the screen potential by 100% or more. Improved scorotrons now in use usually control surface potentials to within about 3% of the reference voltage applied to the screen and operate at efficiencies of about 30% to 50% but they tend to be complex and correspondingly expensive. The Mott U.S. Pat. No. 3,076,092 discloses a DC biased AC corona charging arrangement which does not require a control screen.

Because such corona charging devices ionize the oxygen and nitrogen molecules in the air, they usually generate ozone to an undesirable extent as well as nitrate compounds which tend to cause chemical corrosion. Usually, large charging devices are required to provide a high current capability because of a tendency to produce arcing between the coronode and low voltage conductors of the charging device or the surface being charged at high charging rates.

Another corona charging arrangement contains a row, or two staggered rows, of pins to which a high voltage is applied to produce corona generating fields at the tips of the pins.

Still another corona charging arrangement, called the "dicorotron", has a glass coated corona wire to which an AC voltage is applied and an adjacent DC electrode which drives charges of one polarity charge toward the photoreceptor to be charged while attracting the opposite polarity charges to itself. Dicorotrons, however, are fragile and expensive and, because of the much larger coated wire radius, require very high AC voltages (8–10 kV). They also generate high levels of ozone and nitrates and require substantial spacing of the corona wire from low voltage conducting elements and the surface to be charged in order to avoid arcing.

SUMMARY OF THE INVENTION

Accordingly, it is an object of the present invention to provide a corona charging arrangement having improved efficiency and increased cost effectiveness compared to conventional charging arrangements.

Another object of the invention is to provide a corona charging arrangement by which ozone generation and nitrate production and resulting chemical corrosion are reduced while permitting higher levels of charging current so as to provide high charging rates without arcing.

Still another object of the invention is to provide a corona charging arrangement in which the coronode itself is the only conductive member which determines the equilibrium potential to which the charge-receiving surface is to be charged.

An additional object of the invention is to provide a compact charging arrangement capable of charging a surface at high rates without arcing.

These and other objects of the invention are attained according to one aspect of the invention by providing a corona charging arrangement having a coronode supplied with an AC potential and a DC bias and an insulating structure adjacent to or shielding the coronode. Applying a DC bias to a high frequency AC corona voltage causes the adjacent insulating structure or shielding for the coronode to be charged to a voltage corresponding to the DC bias, and the surface to be charged, such as a photoreceptor, tends to approach the same DC potential as the adjacent insulating structure which is also exposed to the corona generated ions, providing a consistent, dependable and efficient corona charging arrangement.

In one embodiment, a coronode is affixed to and supported by a screen mesh made of insulating fibers and extending parallel to the surface to be charged and in another embodiment a plurality of insulating filaments held by one or more insulating supports embrace the coronode. Parallel insulating filaments which extend between spaced insulating support members and pass on opposite sides of a coronode may be used to support the a coronode which is in the form of a corona wire. In addition, an insulating dielectric member to which a corona wire is held by electrostatic attraction may be used to support the coronode to avoid shadowing or eclipsing of corona generated charges by any part of the support structure. In another embodiment an insulating coating is provided on a corona wire and a capacitor is connected between the AC source and the coronode. The corona charging arrangement of the invention may be used, for example, to provide uniform charge on the surface of the photoreceptor prior to image exposure or for effecting transfer of a toner image from a photoreceptor to a substrate such as paper, or in any other application in which conventional corona charging arrangements are used.

In another embodiment of the invention an insulating structure protects the coronode but makes no contact with it and is arranged so that the capacitance of the coronode to the surface to be charged is greater than the capacitance of the coronode to the adjacent insulating structure. In this embodiment, the only conductive source of the DC bias which determines the asymptotic final potential to which the charge-receiving surface is charged is the DC biased AC coronode itself.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
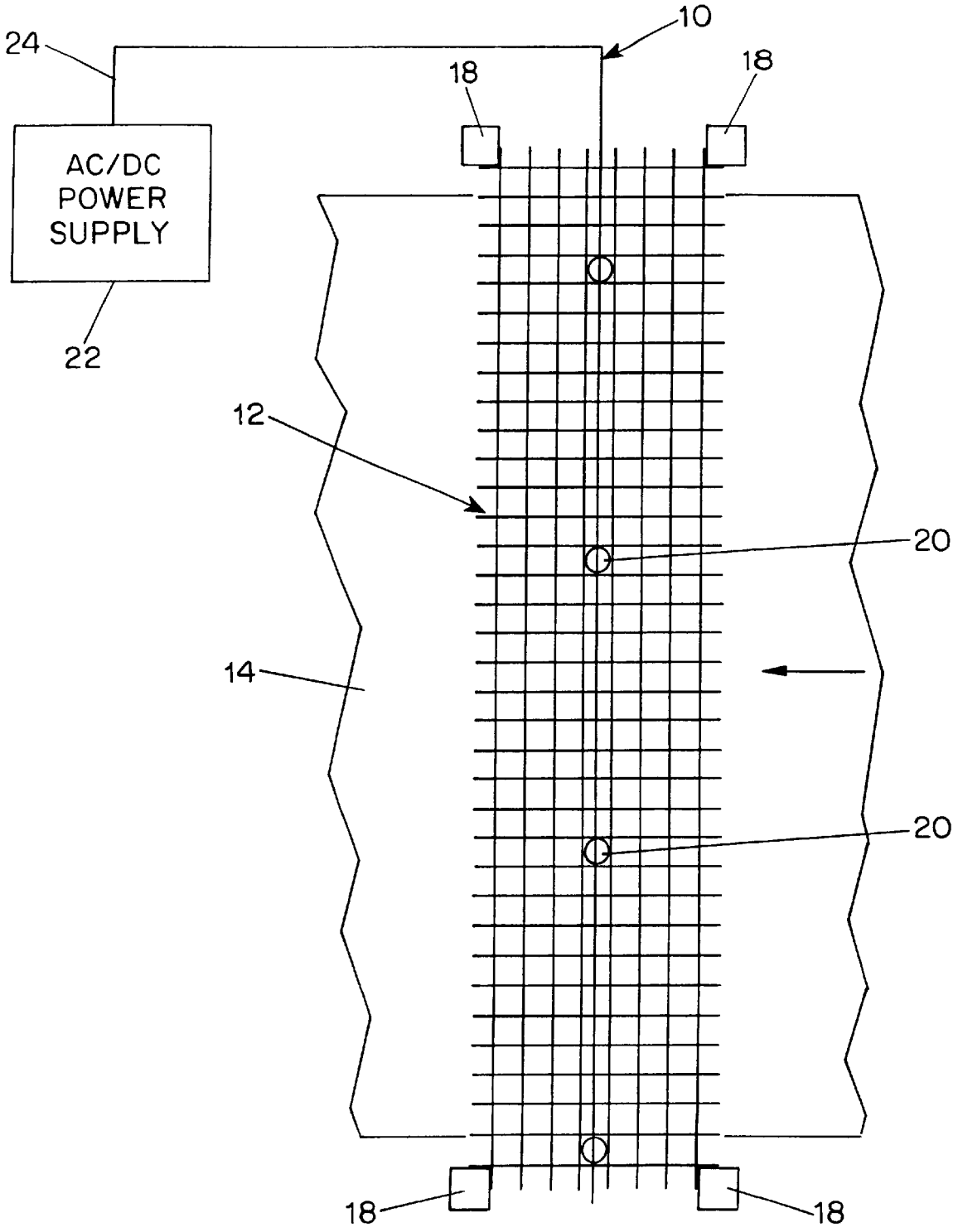
FIG. 1 is a schematic plan view illustrating a representative embodiment of a corona charging arrangement in accordance with the invention.
Figure 2:
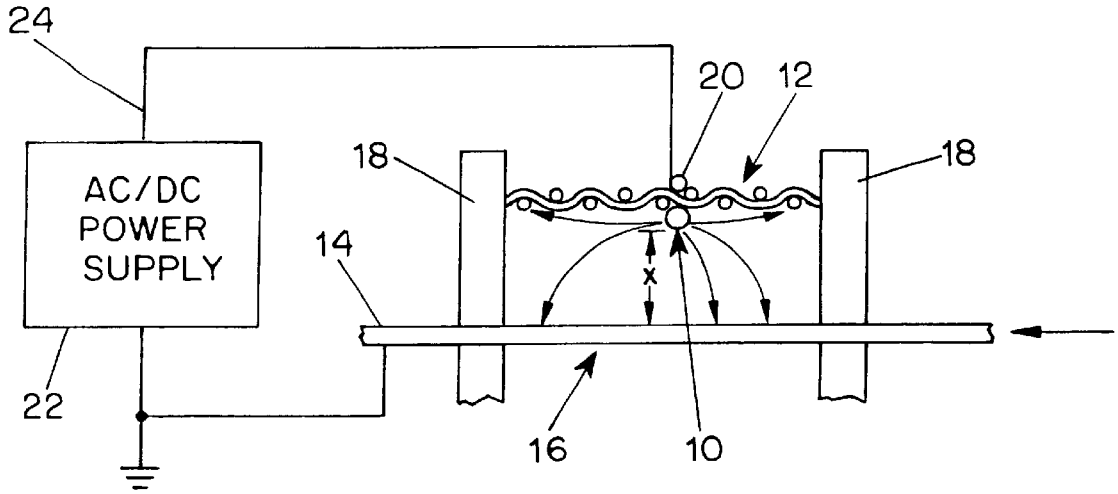
FIG. 2 is an end view of the corona charging arrangement shown in FIG. 1.

In the typical embodiment of the invention illustrated in FIGS. 1 and 2, a coronode in the form of corona charging wire 10 is supported by an insulating member, such as an insulating screen mesh 12, in spaced relation to a surface 14 to be charged, for example, the surface of a photoreceptor 16 moving in the direction indicated by the arrow. The insulating screen mesh 12, which consists of monofilament polyester fibers woven at right angles, is held taut between insulating support members 18 disposed at opposite ends and the coronode 10 is attached to the screen 12 at intervals by a polyester monofilament thread 20. The coronode 10 has a diameter which may, for example, be from about 1.5 mils (0.038 mm) to 2.0 mils (0.051 mm) and may be spaced from the surface 14 to be charged by a distance, x, which may, for example, be from about 3.0 mm to about 4.5 mm.

In a typical charging arrangement of the type shown in FIGS. 1 and 2, the insulating screen mesh 12 consisted of a commercial screen printing mesh made from monofilament polyester fibers 7 mils (0.178 mm) in diameter woven at right angles at a spatial frequency of 60 fibers per inch (23.6 fibers per cm) providing an open screen area of about 33%. The coronode was tied to the screen using a 5 mil (0.127 mm) diameter polyester monofilament strand 20 at spacings of 4.2 mm. This arrangement was found to be sufficient, even at small spacings such as 3 mm, to resist the electrostatic forces tending to draw the coronode and the insulating mesh toward the surface being charged which, if permitted, could result in arcing, causing holes to be melted in the mesh. As a result, a more compact charging arrangement is possible.

An AC-DC power supply 22 such as a TREK Model 615 AC/DC power supply providing a high voltage output 24 is connected to the coronode 10. When an appropriate high voltage is applied to the coronode 10 in the manner described below, corona generated electrons and negative ions are drawn toward the surface 14 to be charged, which is at ground potential, as shown by the arrows on FIG. 2. Because the screen 12 is made of insulating material, no net DC current is drawn by the screen and it tends to remain approximately at the DC potential level of the coronode. Any ions deposited on the screen tend to repel other ions toward the surface to be charged increasing the charging efficiency.

To determine the optimum charging characteristics for the arrangement shown in FIGS. 1 and 2, a coronode having a 2 mil (0.05 mm) diameter was used and AC voltages of 8 kV to 9.5 V (peak to peak) at a frequency of 2 kHz with a DC bias in the range from +600 to −600 volts was applied to the wire with spacings x of 4.5 mm and 3.0 mm. The frequency of the AC potential applied to the corona charging wire must be high enough that the AC half cycle is shorter than the transit time of charges across the space to the surface to be charged in order to avoid arcing. Also, the use of a high frequency eliminates strobing of the charge pattern. In order to determine the AC frequency to be used, the AC voltage was applied with increasing frequency up to just over 2.1 kHz at which point the power supply 22 indicated an overload. Accordingly, all of the subsequent test data were taken with the AC voltage applied at a frequency of 2.0 kHz. Preferably, for spacings on the order of 3.0–4.5 mm and DC bias potentials of the type described herein, the AC frequency should be at least 0.5 kHz and desirably at least 1.0 kHz.

In order to determine the appropriate DC bias voltage to charge the charge-receiving surface to −700 V, for example, charging current curves were plotted using the parameters described above and the DC bias that gave zero charging current to the surface 14 of a bare plate at ground potential was determined. The plate current was then determined with a DC bias on the corona decreased by −700 volts from that of the bias giving zero plate current providing a "starting bias" value of current or "starting current". The "starting current" determines the rate at which the photoreceptor reaches the equilibrium value of −700 V in this example. For a photoreceptor surface 14 which moves with respect to the corona charging arrangement at a rate of 10 cm/sec it has been 10 found that the minimum starting current required to produce the desired charge uniformly distributed on the photoreceptor surface is 2.8 $\mu$A/cm.

Figure 3:
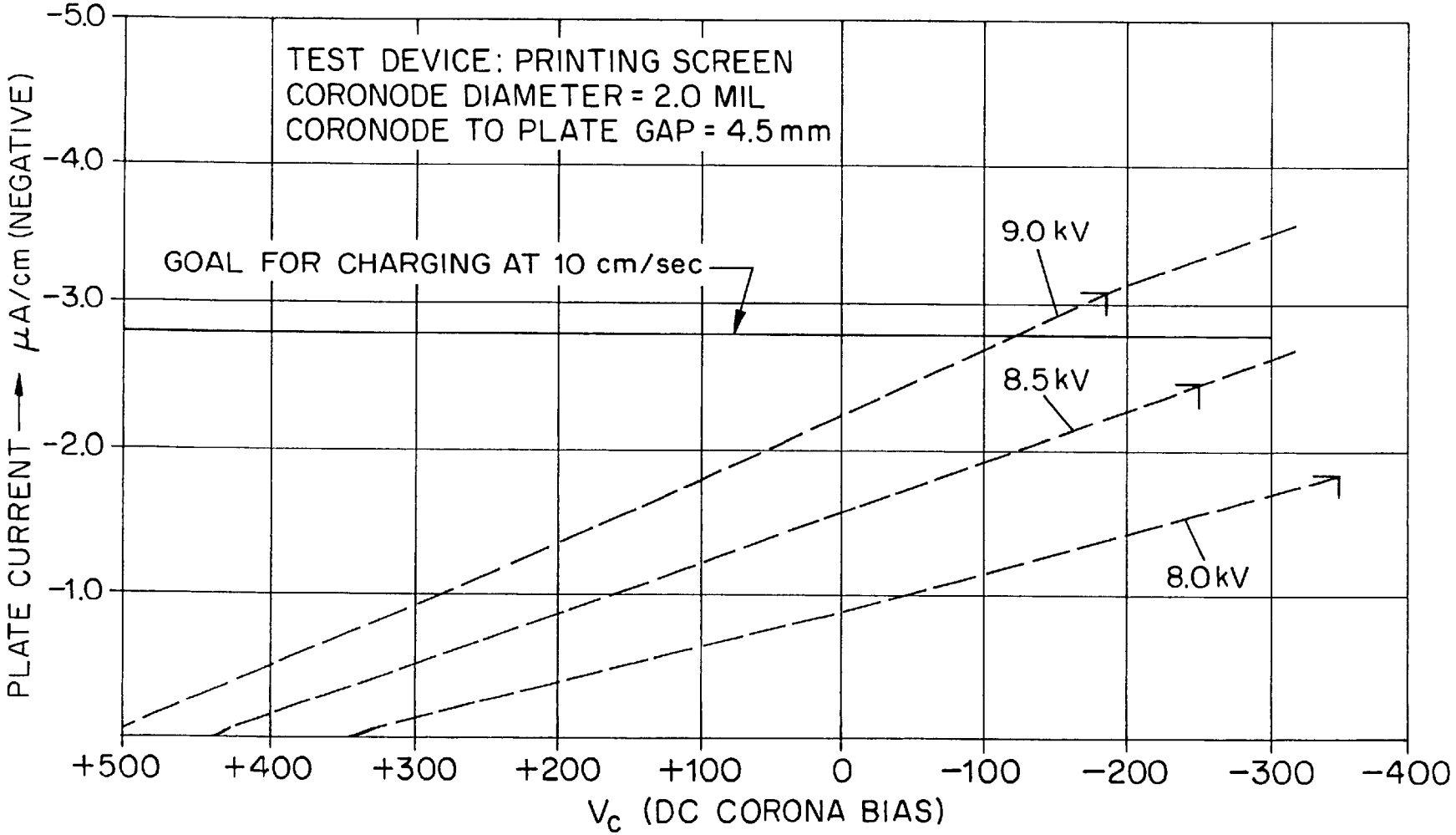
FIG. 3 is a graphical representation illustrating the charging characteristics of a representative charging arrangement of the type illustrated in FIGS. 1 and 2.
Figure 4:
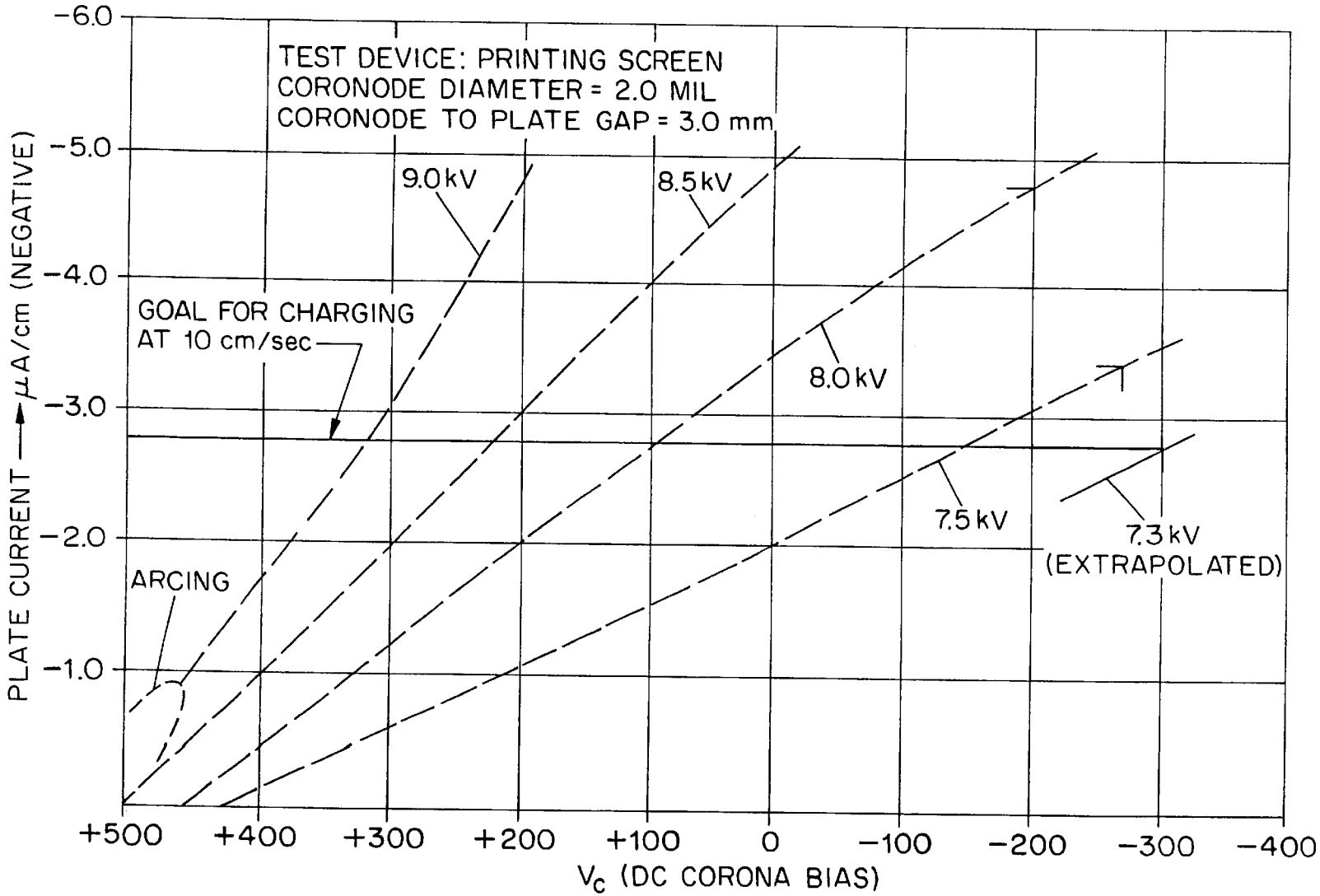
FIG. 4 is a graphical representation showing the charging characteristics of another charging arrangement of the type shown in FIGS. 1 and 2.

The results of these tests are illustrated graphically in FIGS. 3 and 4 for a charging arrangement of the type shown in FIGS. 1 and 2, with the spacing between the coronode and the surface to be charged at 4.5 mm for the data shown in FIG. 3 and 3.0 mm for the data shown in FIG. 4. As illustrated in FIG. 3, a 9 kV AC voltage on the coronode provides 3.08 $\mu$A/cm or 110% of the minimum "starting current" when the coronode is biased to a DC "starting bias" of −180 volts. By interpolation from the other curves shown in FIG. 3, it can be determined that an AC voltage of 8.8 kV and a starting bias of −215 volts also provides the required starting current of 2.8 $\mu$A/cm. As shown in FIG. 4, for a spacing x of 3.0 mm, the required plate current of 2.8 $\mu$A/cm can be obtained using an AC voltage as low as 7.3 kV at a starting bias of −300 volts.

Figure 5:
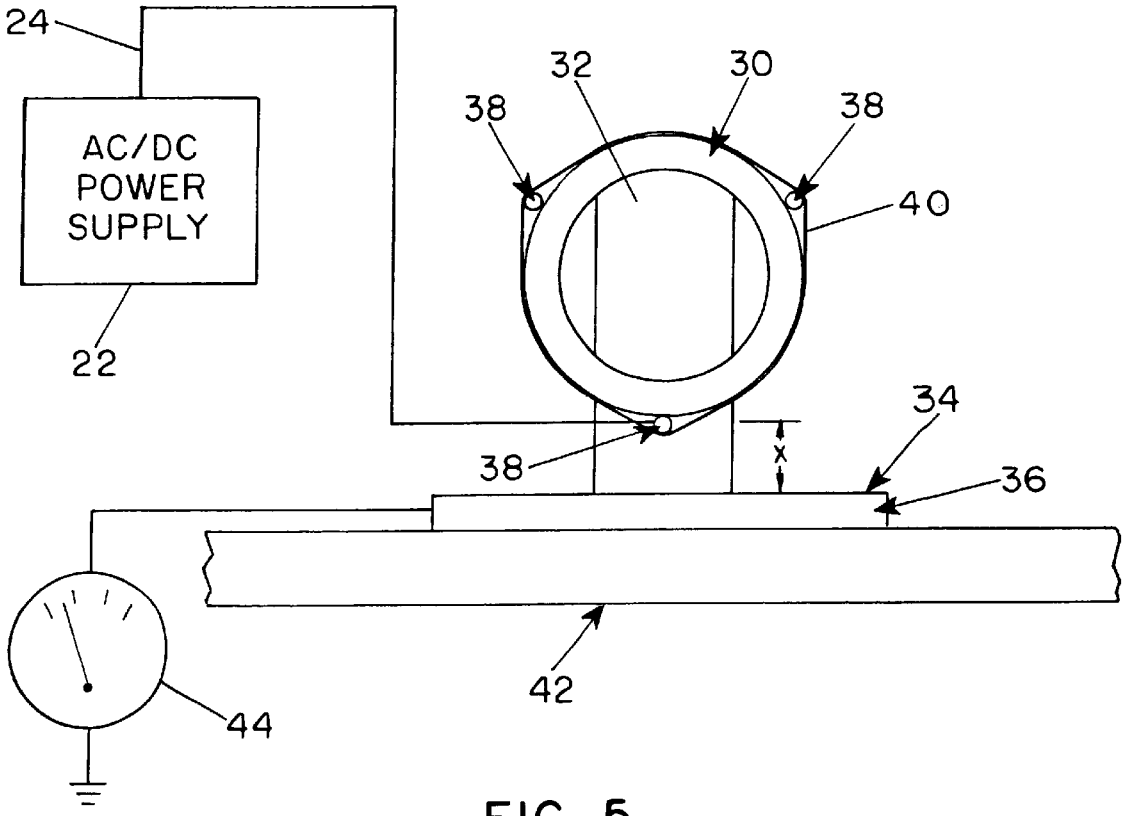
FIG. 5 is a schematic end view illustrating a test arrangement for testing charging characteristics of corona charging arrangements.

FIG. 5 shows an arrangement for testing charging characteristics of coronodes held against an imperforate insulating member. In this arrangement, a hollow insulating tube 30, rotatably held at opposite ends by insulating supports 32 and extending parallel to a surface 34 of a conductive plate 36 to which current is to be applied, carries three coronodes 38 of different diameters spaced at uniform intervals about its circumference. The coronodes 38 are held against the surface of the tube by insulating filament strands 40 which are wound around the coronodes 38 and the surface of the tube 30. In the illustrated embodiment, the insulating tube 30 is a polyvinyl chloride pipe which has an outer surface formed with threads at 24 grooves per inch (about 1 groove per mm) and a 5 mil (0.127 mm) diameter polyester monofilament fiber 40 is wound around the tube 30 so as to be received in the grooves and retain the coronodes 38 in position against the outer surface of the tube.

In the arrangement shown in FIG. 5, the conductive plate 36 is held on an insulating support 42 and a microammeter 44 is connected between the conducting plate 36 and ground to measure the charging current provided by each of the coronodes 38.

The three coronodes 38 have diameters of 1.5 mils (0.038 mm), 2.0 mils (0.051 mm) and 3.5 mils (0.089 mm), respectively, and the spacing to the surface 34 was varied from 3.5 mm to 4.5 mm. The wires 38 are connected alternately to the power supply 22 when the tube 30 is rotated to place the corresponding wire adjacent to the plate 36.

Figure 6:
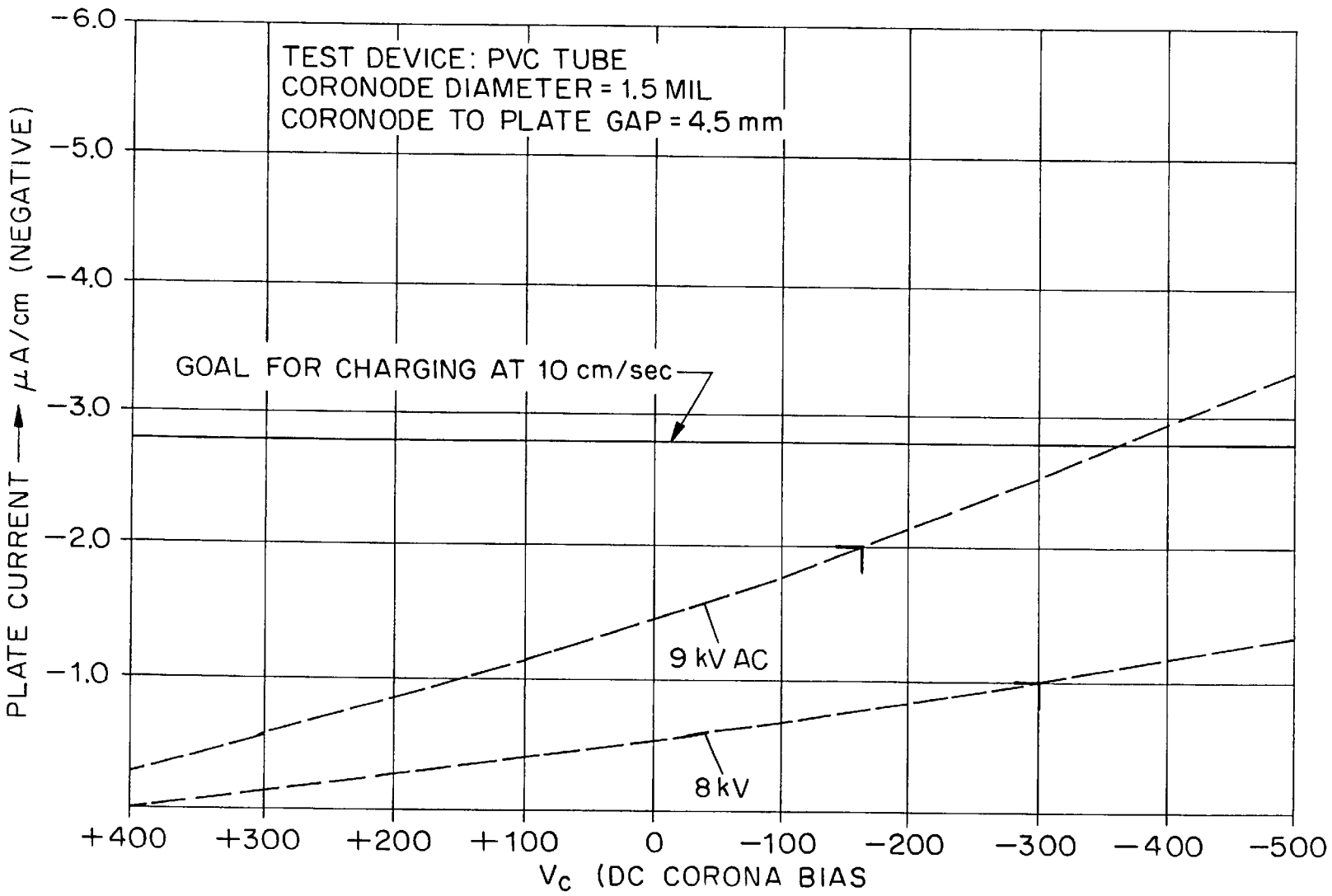
FIG. 6 is a graphical representation illustrating the charging characteristics of a representative charging arrangement of the type shown in FIG. 5.
Figure 7:
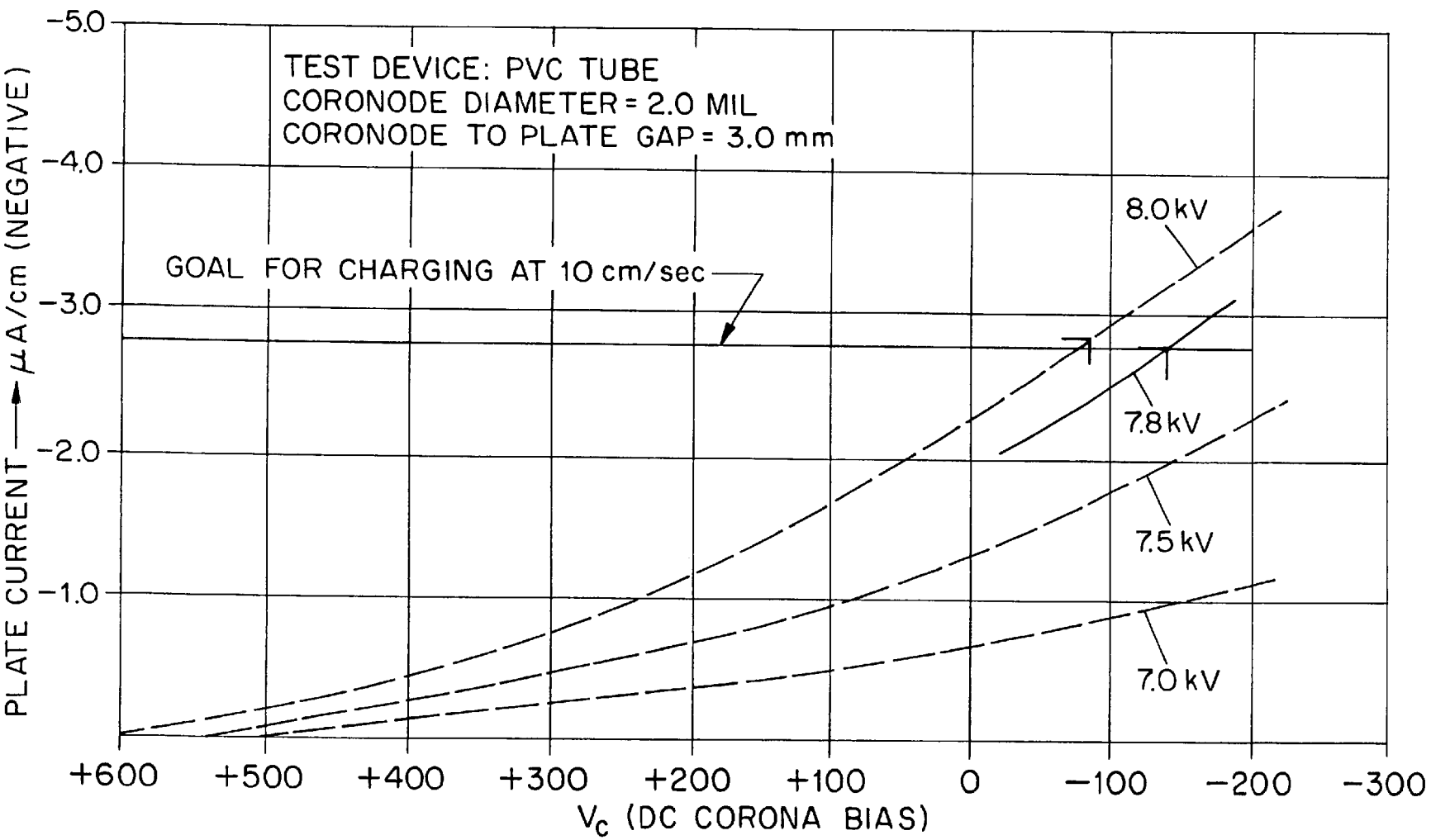
FIG. 7 is a graphical representation showing the charging characteristics of another charging arrangement of the type shown in FIG. 5.

FIG. 6 illustrates graphically the charging characteristics using the coronode 38 having a diameter of 1.5 mil (0.038 mm) and a spacing x of 4.5 mm and FIG. 7 shows the charging characteristics using the coronode 38 having a 2.0 mil (0.051 mm) diameter and a spacing x of 3.0 mm. As shown in FIG. 6, at a spacing x of 4.5 mm the smallest diameter (1.5 mil) coronode requires a corona voltage of more than 9 kV to obtain the required current of 2.8 $\mu$A/cm. On the other hand, FIG. 7 shows that for a spacing x of 3.0 mm the required starting current of 2.8 $\mu$A/cm can be obtained using a corona voltage of 7.8 kV on a 1.5 mil diameter coronode. For a larger diameter coronode, the charging currents were lower at each of the spacings. Thus, although a coronode which is placed in contact with an imperforate surface of dielectric material as in FIG. 5 produces adequate charging, it provides about 50% less corona current to a surface to be charged than a coronode which is supported free in space such as by the mesh screen of FIGS. 1 and 2. It is not certain whether the primary reason for the reduction in charging current is the impedance provided by an imperforate surface to air flow, which could result in recombination of positive and negative ions, or by the capacitive coupling that diverts many of the field lines that would otherwise reach out into space toward the bare plate, or by high percentage of the insulating filament area covering the coronode. The insulating filaments 40 might be a cause of reduced charging current even though, in the arrangement described above with reference to FIG. 5, the area covered by the filaments 40 is only about 13% of the total area of the coronode. This suggests that the "eclipsing" or "shadowing" effect is not as great as the losses resulting from dielectric coupling of the electric fields to the filaments and to the dielectric support surface.

Further tests showed that, using a coronode of 2.0 mil (0.051 mm) diameter at spacings of 4.5 mm, 3.4 mm and 3.0 mm, respectively, from a conductive base plate, AC voltages of 7.5, 8.0 and 8.75 kV produced starting currents of 3.7, 4.3 and 4.7 $\mu$A/cm, respectively. By extrapolation, the minimum coronode voltage needed to produce the required 2.8 $\mu$A/cm would be about 7.0 kV. Similar tests using a 3.4 mm spacing indicate starting currents of 3.2, 3.85 and 4.25 $\mu$A/cm for AC voltages of 6.5, 7.0 and 7.5 kV, respectively. By extrapolating these data, the minimum coronode voltage needed to produce the required 2.8 $\mu$A/cm is about 6.3 kV with a 3 mm spacing with starting currents of 4.0, 5.85 and 7.0 $\mu$A/cm for AC voltages of 6.0, 6.5 and 7.0 kV. respectively. By extrapolation, these data show that an AC voltage of only about 5.5 kV is necessary to produce the required 2.8 $\mu$A/cm at coronode to plate spacing of 3 mm.

Figure 8:
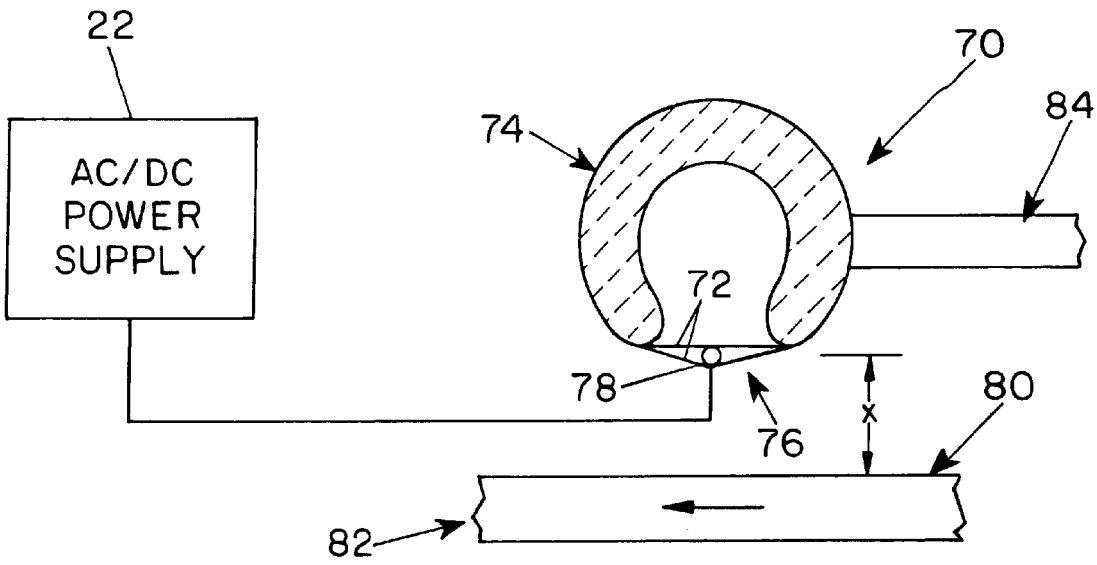
FIG. 8 is a schematic end view illustrating another representative embodiment of a corona charging arrangement according to the invention for charging the surface of a photoreceptor.

FIG. 8 illustrates schematically another charging arrangement 70 in accordance with the invention. This charging arrangement includes an array of insulating filaments 72 which are wound around a tube-type insulating support member 74 having an open side 76 so as to pass alternately above and below a coronode 78 at the open side, thus holding the coronode 78 in a fixed position while permitting circulation of air past the wire. The coronode 78 is supported at a spacing x of about 3 mm from the surface 80 of a photoreceptor 82 which is driven past the charging arrangement 70 at a rate of, for example, 10 cm/sec in the direction indicated by the arrow. The tubular member 74, which may, for example, have an outer diameter of about 8 mm and an inner opening of about 4 mm diameter, is supported at opposite ends by insulating supports 84 so as to maintain the coronode 78 at the desired spacing x from the surface 80 of the photoreceptor 82.

Figure 9:
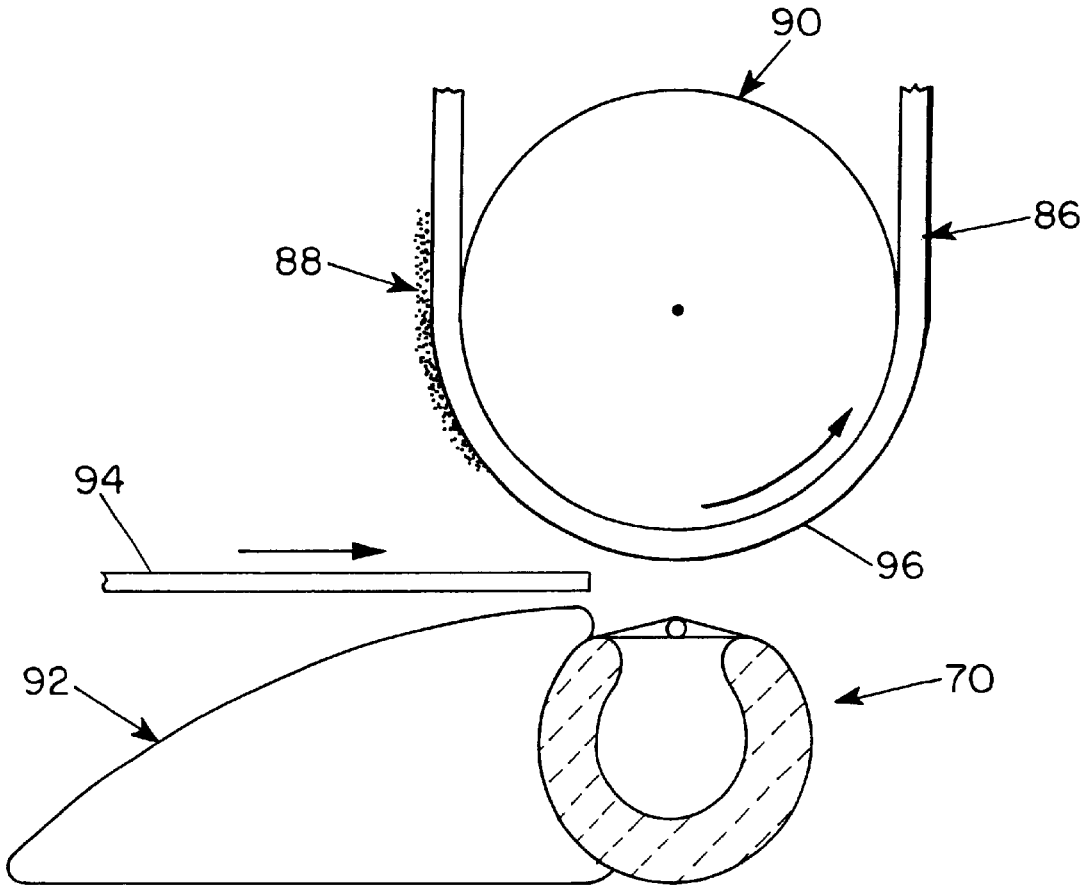
FIG. 9 is a schematic end view illustrating the charging unit shown in FIG. 8 arranged for use in transferring a toner image from a photoreceptor to a substrate.

FIG. 9 illustrates a corona charging arrangement of the type shown in FIG. 8 for use in image transfer from a photoreceptor to a substrate. In this illustration, a charging arrangement 70 of the same type described above with a reference to FIG. 8 is disposed in spaced relation a photoreceptor 86 bearing a toner image 88, the photoreceptor 86 being driven by a drive roll 90 in the direction indicated by the arrow. A substrate guide 92 is mounted adjacent to the charging arrangement 70 to guide a substrate sheet 94 such as a sheet of paper adjacent to the surface 96 of the photoreceptor 86 so that the substrate sheet is moved against the surface 96 as a result of the charge applied by the charging arrangement 70, thereby causing the toner image 88 to be transferred to the surface of the substrate, after which the substrate is delivered to a conventional fixing unit for fixing the toner image on its surface.

In another corona charging arrangement according to the invention, the insulating screen mesh 12 of FIGS. 1 and 2 was replaced by a plate of insulating dielectric material rigidly held in position at the required spacing x from the photoreceptor. When a DC biased AC potential was applied to a coronode 10 in the manner described above, the coronode was drawn to and held against the dielectric sheet, thereby preventing sagging or "singing" of the coronode during charging of the adjacent photoreceptor. While such adjacent insulating structures tend to accumulate charge, which quenches charge emission from a DC coronode and repels the wire from contact with the dielectric surface of corona emission, it was found that there was no undue quenching when a DC biased AC potential is applied to the wire. The dielectric plate of this embodiment need not have a planar surface. It may, for example, be scored with parallel grooves to reduce capacitance effects which tend to decrease the efficiency of the corona emission. Moreover, with this arrangement, there are no insulating filaments or support members covering the side of the coronode facing the surface to be charged.

With the unique corona charging arrangement according to the invention, wherein a coronode is disposed in close proximity to an insulating member, it has been found that the charging efficiency (i.e., the proportion of charges generated by the coronode which reach the surface to be charged) is increased and the corona charging current is also increased without requiring higher voltage, thereby solving the problem of providing increased charging rates without arcing. As a result, smaller and more compact corona charging arrangements are possible. Moreover, the generation of ozone and nitrate ions is reduced.

Figure 10:
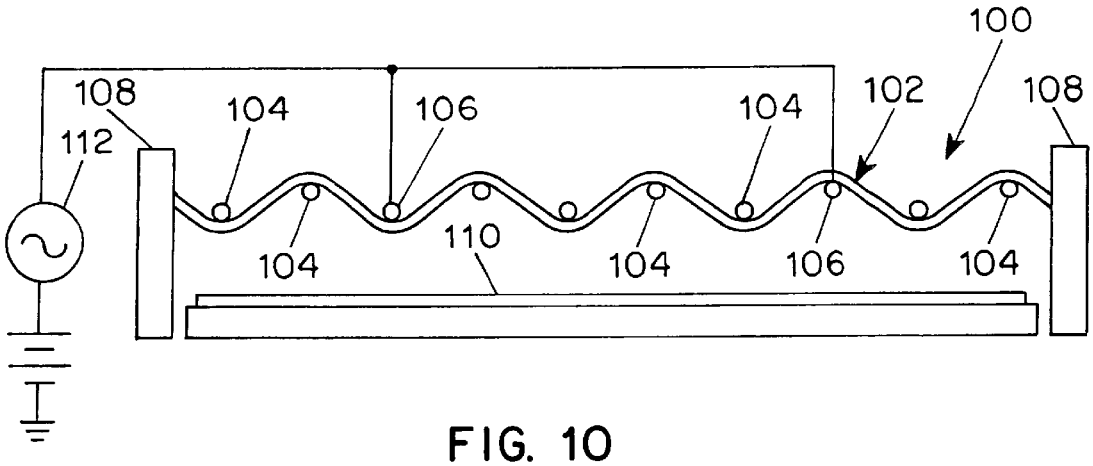
FIG. 10 is a schematic end view illustrating yet another embodiment of the invention which can be efficiently produced and easily handled.

In the further representative embodiment of the invention schematically shown in FIG. 10, a corona charging arrangement 100 has the basic characteristic of the embodiments described above, but is more easily handled and can be more efficiently produced. In this embodiment a woven fabric 102 of insulating filaments 104 is provided with one or more parallel conductive filaments 106 constituting coronodes in place of one or more of the insulating filaments extending in one direction. The fabric 102 is supported by insulating supports 108 in closely spaced relation to a charge-receiving surface 110 and the spatial frequency of the woven filaments 104 in the woven fabric should be such that the spacing between adjacent fibers is no greater than the spacing between the plane of the woven fabric and the adjacent charge receiving surface 110.

In a preferred embodiment, requiring a slightly larger fabric area, two coronodes 106 are woven into the fabric as shown in FIG. 10. In this case, the coronodes 106 are woven into the crossing filaments in out of phase relation so that the resulting periodic charging currents will average to provide a very uniform potential on the surface 110 of the charge receiving member. In addition, the coronodes 106 should be spaced from each other by at least twice the distance between the woven fabric 102 and the charge receiving surface 110 to prevent mutual suppression of the corona fields from each coronode. As in the other embodiments, the coronodes are connected to a source of DC-biased AC voltage 112.

It has also been found that a uniform charge can be applied to an adjacent surface using an AC voltage applied to a coronode having a dielectric coating without producing the disadvantages of the prior art dicorotron if a capacitor is connected between the AC voltage source and the corona wire as described in the copending application Ser. No. 09/420,393, filed Oct. 18, 1999 now U.S. Pat. No. 6,205,309, the disclosure of which is incorporated herein by reference. In this connection, a dielectric coating on an AC coronode is normally subjected to excessively high potential fields for two reasons. First, there is a substantial difference in the corona threshold potential for positive and negative corona. For example, a conductive wire 50 $\mu$m in diameter spaced 3 mm from a conducting plate begins to emit corona current at 3,000 volts positive. Under negative potential, however, the same wire begins to emit corona currents at 2,800 volts negative. Therefore, a thin insulating overcoating which is unable to pass net positive or negative current will automatically bias itself to a voltage which will deliver equal positive and negative charges alternately at the AC frequency applied. The thin coating may have a thickness in the range from about 0.5 $\mu$m to about 2.5 $\mu$m, preferably about 1 $\mu$m. That results in a bias of +100 volts on the surface of the overcoating, producing a field of 100 volts per micrometer across the thin overcoating film. For a glass overcoating of about 75 $\mu$m thickness of the type used in a dicorotron, with its normal dielectric strength of 3 V/$\mu$m, that bias creates a safe field of 1.3 V/$\mu$m. For a very thin dielectric coating, however, a problem arises in that the dielectric stress of the differential corona thresholds increases inversely with diminishing thickness.

The other fields across the dielectric overcoating result from the charges associated with the AC corona currents. Each alternate half cycle these charges add to, then subtract from, the positive differential corona threshold bias on the surface, adding to the dielectric breakdown fields applied to the overcoating during the positive half cycle. The voltage alternately added, then subtracted, by the charges associated with each half-cycle of a 2 kHz AC charging voltage can be calculated from the capacitance of the surface of the insulating coating to the conducting core of the coronode. The relationship of the surface potential to the charge density on the surface is given by the equation, $V=\sigma/C$. The capacitance per unit length of the surface of the insulating dielectric to the wire is given by:

$$C=K\in_o/In(b/a)$$

where

K is the dielectric constant, $\in_o$ is the permittivity of space ($8.85\times10^{-12}$), b is the outside radius of the dielectric coating, and a is its inner radius, or the radius of the conducting wire core.

Assuming a coating of 1 $\mu$m thickness, $$C=4\times9\times10^{-12}/In(26/25)=4\times9\times10^{-12}/0.04=9\times10^{-11}\text{farads/cm length.}$$

If the bulk resistivity of the dielectric overcoating on the coronode is in the order of $10^{12}$ ohm-cm, its relaxation time constant, $\tau$, will be K x resistivity $\times10^{-13}$. For example, for a dielectric constant of K=4, and a resistivity of $10^{12}$ ohm-cm, $\tau$ would be 0.4 seconds. That is sufficiently longer than the half-cycle time for an AC frequency of 22 kHz (1/4000th second), so that the overcoating acts as an insulator in that time context, yet the relaxation time is short enough to reach equilibrium in about a second.

In general, if the resistivity of the dielectric material of the overcoating is in the range from about $10^{12}$ ohm-cm to about $10^{14}$ ohm-cm, the overcoating acts as an insulator at high frequencies, but allows a slower DC charge flow to give the right bias between the two capacitances.

To determine the surface charge per unit length, $\sigma$, the starting current per unit length required for charging the photoreceptor at 10 cm / sec, i.e., 2.8 $\mu$A/cm as described above, is used. To provide this starting current, $1/2000\times2.8$ $\mu$Coulombs/cm should be applied per AC cycle, assuming an AC frequency of 2 kHz. So $\sigma=1/4\times10^{-9}$. From the above, that charge gives a maximum surface potential from the charge during each cycle of $V=\sigma/C=1.4\times10^{-9}/9\times10^{-11}=16$ Volts/$\mu$m. Because the surface potential is proportional to the thickness of the dielectric layer, and the field stress across the dielectric coating is defined by volts per unit thickness, the dielectric stress caused by the AC corona currents will be independent of the thickness.

Therefore, for a current of 2.8 $\mu$A/cm, the dielectric stress on the overcoating due to the charge deposited on its surface during each cycle will be 16 volts/$\mu$m, and that must be added to the bias of 100 volts impressed by the different positive and negative corona threshold bias values discussed above.

Obviously, for xerographic copiers or printers operating at higher speed the currents must be increased proportionally, raising the dielectric stress on the insulating overcoating of the coated wire in proportion to the speed requirement. This quickly becomes a severe challenge for thin overcoating materials such as those having dielectric breakdown fields in the range of 3 to 100 V/$\mu$m.

In accordance with one aspect of the invention, however, this problem is overcome by connecting a capacitor capable of supporting at least several thousand volts between the AC power supply and the corona wire. In order to deliver, for example, 90% to 99% of the power supply voltage to the corona wire, the capacitance of a connecting capacitor should be in the order of at least about 10 to 100 times greater than the capacitance of the wire to its enclosure. The capacitance of the coated wire to the shield and photoreceptor is $C=K\in_o/\ln(b/a)$, where b is the inner radius of the shield and a is the radius of the coronode. For example, assuming a coronode of $2.5/10^{-2}$ mm radius in a cylindrical shield of 3 mm radius, the capacitance of the wire in the cylinder is given by:

$$C=9\times10^{-12}/In\ 120=1.9\times10^{-12}5\text{farads/meter, or 0.02 pF/cm length of wire.}$$

That makes the capacitance of 25 cm length of wire, for example, 0.50 pF. In the case of a 25 cm wire, that would require providing a connecting capacitor with a capacitance of at least 5 pF to 50 pF to ensure that 90% to 99% of the power supply voltage is impressed on the coronode. With an AC frequency of 2 kHz, the capacitor charges only to about 4% of the peak voltage in the 1/4000 second of each half cycle. This is understandable, since corona current doesn't begin until the threshold voltage is reached. At 6.5 kV AC, peak potentials are +/−3.25 kV, while the corona threshold is about 2.9 kV With this arrangement, a corona charging system is provided in which currents are limited by two capacitances, one from a capacitor of high voltage rating placed in series with the AC power supply and the coronode, and one constituting distributed capacitance produced by the uniform dielectric coating on the corona wire. The combination provides the necessary protection against dielectric breakdown of the insulating coating on the coronode by dividing the dielectric biases across the two capacitors appropriately.

Figure 11:
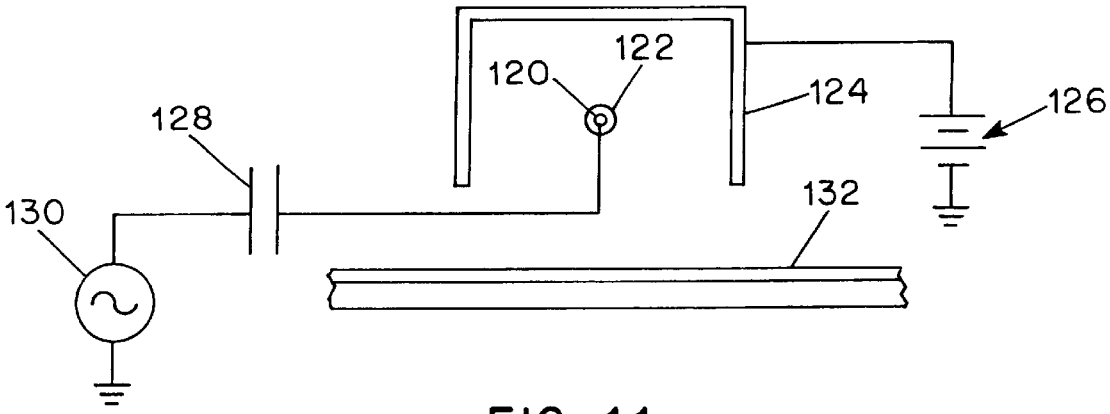
FIG. 11 is a schematic end view illustrating an additional embodiment of the invention.

In a typical embodiment of the invention using a coronode having a thin dielectric coating shown in FIG. 11, a coronode 120 provided with a dielectric coating 122 is supported within a conductive shield 124 which is connected to a negative voltage source 126. The coronode 120 is supplied with voltage through a capacitor 128 from an AC power source 130. Preferably, the coronode 120 is a corona wire having a diameter in the range from about 35 $\mu$m to about 70 $\mu$m and a dialectic layer 122 with a thickness in the range from about 0.5 $\mu$m to 1.5 $\mu$m, and the capacitor 128 has a capacitance of at least about 50 picofarads. In one arrangement according to FIG. 11, the wire 120 had a diameter of 50 $\mu$m and the dielectric layer 122 had a DLN dielectric coating 0.7 $\mu$m thick with a resistivity of $3\times10^{13}$ ohm-cm. The coronode 120 was enclosed on three sides by the conductive shield 124 which had a width of 8 mm and side walls 5 mm high and was spaced by 3 mm from the surface of a conductive base plate 132 and the capacitor 128 had a capacitance of 6 manofarads.

Figure 12:
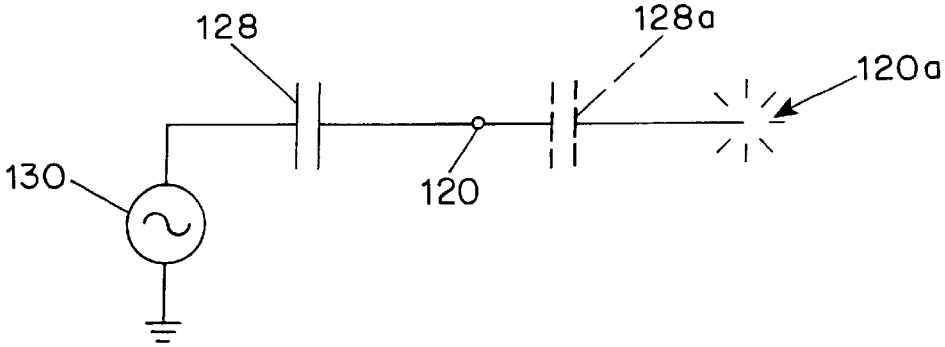
FIG. 12 is a schematic diagram illustrating the equivalent circuit for the arrangement shown in FIG. 11.

FIG. 12 shows the equivalent electrical circuit of this arrangement in which the distributed capacitance of the dielectric layer 122 is represented by a capacitor 122*a* and the corona discharge is represented by ions 120*a*.

Figure 13:
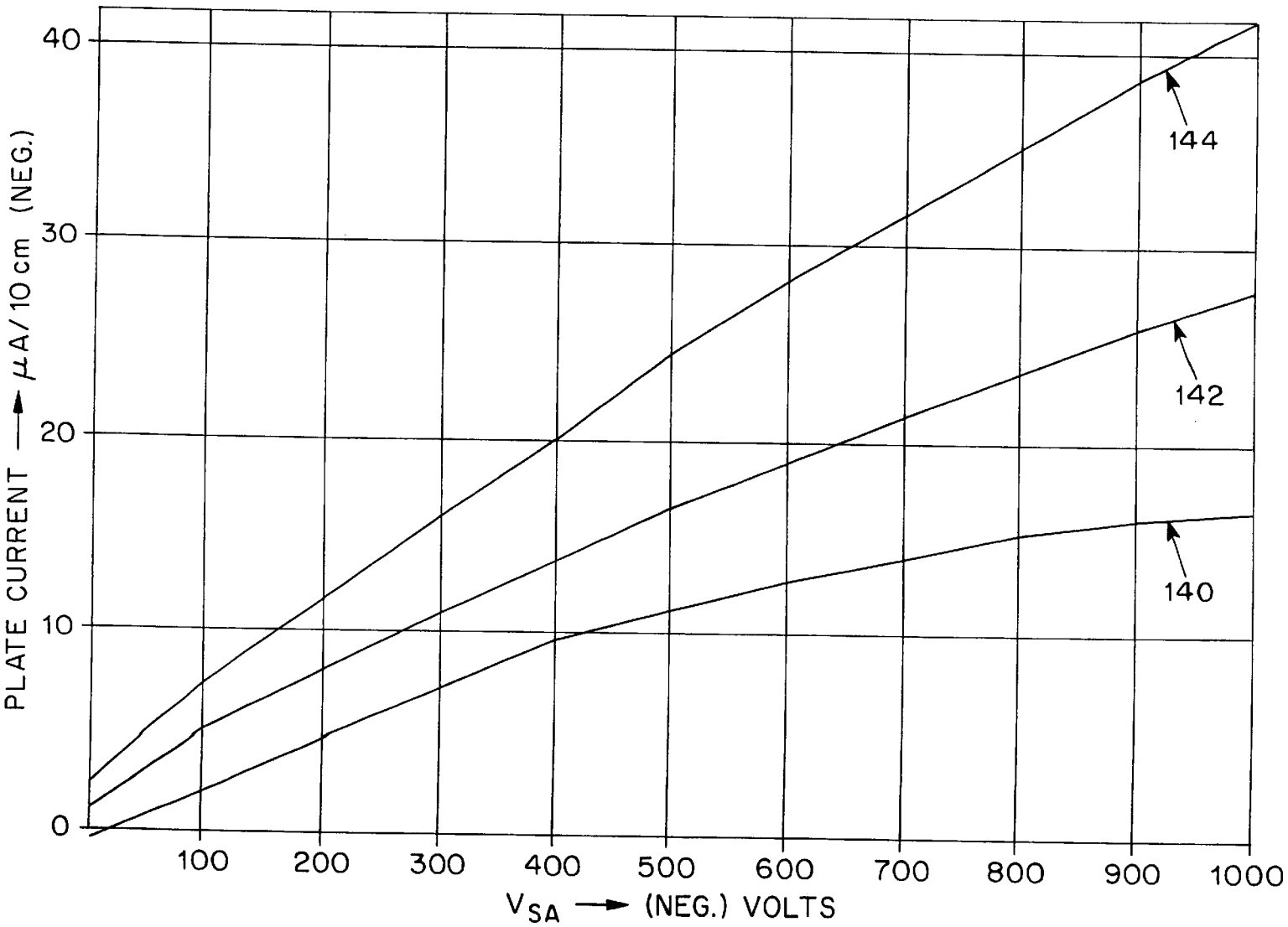
FIG. 13 is a graphical illustration showing the relation between shield bias and plate current for different AC voltages applied to the coronode in the embodiment of FIG. 11.

With this arrangement a substantially linear relation, although slightly concave downwardly, was obtained between the shield voltage and the plate current with a curve passing close to the origin. For example, the curve 140 of FIG. 13 was produced with an applied AC voltage of 6.0 kV, the curve 142 was obtained with an AC voltage of 6.5 kV and the curve 144 was obtained with a voltage of 7.0 kV.

Although the invention has been described herein with reference to specific embodiments, many modifications and variations therein will readily occur to those skilled in the art. Accordingly, all such variations and modifications are included within the intended scope of the invention.

I claim:

1. A corona charging arrangement comprising:

at least one elongated coronode positioned in spaced relation to the location of a surface to which corona charges are to be applied;

an insulating supporting structure including an insulating member extending along and adjacent to the coronode; and a voltage source supplying a DC biased AC voltage between the coronode and the surface to which corona charges are to be applied.

2. A corona charging arrangement according to claim 1 wherein the coronode is a corona charging wire which has a diameter in the range from about 1.0 mil (0.025 mm) to about 3.5 mils (0.089 mm).

3. A corona charging arrangement according to claim 1 wherein the insulating member is positioned to provide a spacing between the coronode and a surface to be charged in the range from about 3 mm to about 4.5 mm.

4. A corona charging arrangement according to claim 3 wherein the AC voltage has a frequency of about 2 kHz.

5. A corona charging arrangement according to claim 1 wherein the AC voltage has a frequency of at least 0.5 kHz.

6. A corona charging arrangement according to claim 5 wherein the AC voltage has a frequency of at least 1.0 kHz.

7. A corona charging arrangement comprising:

at least one elongated coronode positioned in spaced relation to the location of a surface to which corona charges are to be applied;

an insulating supporting structure including an insulating member extending along and adjacent to the coronode; and an AC voltage source supplying AC voltage to the coronode, wherein the insulating member comprises an imperforate insulating member.

8. A corona charging arrangement comprising:

at least one elongated coronode positioned in spaced relation to the location of a surface to which corona charges are to be applied;

an insulating supporting structure including an insulating member extending along and adjacent to the coronode; and an AC voltage source supplying AC voltage to the coronode, wherein the insulating member comprises an array of insulating filaments which are in spaced contact with the coronode in the direction along the coronode.

9. A corona charging arrangement according to claim 8 wherein the insulating filaments have a diameter of about 7 mils (0.178 mm) and are spaced by about 1 mm between centers.

10. A corona charging arrangement according to claim 8 wherein the array of insulating filaments is part of a woven mesh.

11. A corona charging arrangement according to claim 10 wherein the coronode is affixed to the woven mesh by insulating tie filaments.

12. A corona charging arrangement comprising:

at least one elongated coronode positioned in spaced relation to the location of a surface to which corona charges are to be applied;

an insulating supporting structure including an insulating member extending along and adjacent to the coronode; and an AC voltage source supplying AC voltage to the coronode, wherein the insulating member includes an array of spaced insulating filament strands extending transversely to the direction of elongation of the coronode and spaced along the length of the coronode.

13. A corona charging arrangement according to claim 12 including an insulating support member having a surface extending parallel to the direction of elongation of the coronode and wherein the array of insulating filament strands comprises at least one filament extending around the insulating support member and holding the coronode in fixed position with respect to the insulating support member.

14. A corona charging arrangement according to claim 13 wherein the insulating support member has a threaded external surface and the insulating filament strands are engaged in the threads of the threaded surface.

15. A corona charging arrangement comprising:

at least one elongated coronode positioned in spaced relation to the location of a surface to which corona charges are to be applied;

an insulating supporting structure including an insulating member extending along and adjacent to the coronode; and an AC voltage source supplying AC voltage to the coronode, wherein the insulating member comprises at least one insulating support member extending parallel to the direction of elongation of the coronode and an array of the insulating filament strands supported by the insulating support member and passing on opposite sides of the coronode.

16. A corona charging arrangement according to claim 15 wherein the insulating support member has a threaded outer surface and wherein the filaments engage the thread grooves in the threaded surface.

17. A corona charging arrangement comprising:

at least one elongated coronode positioned in spaced relation to the location of a surface to which corona charges are to be applied;

an insulating supporting structure including an insulating member extending along and adjacent to the coronode; and an AC voltage source supplying AC voltage to the coronode, wherein the insulating member comprises at least two spaced insulating support members extending parallel to the direction of elongation of the coronode and an array of filament strands extending between the spaced insulating support members.

18. A corona charging arrangement comprising:

at least one elongated coronode positioned in spaced relation to the location of a surface to which corona charges are to be applied;

an insulating supporting structure including an insulating member extending along and adjacent to the coronode; and an AC voltage source supplying AC voltage to the coronode, wherein the insulating member comprises a tubular insulating member having an open side and wherein the coronode is supported in the open side of the tubular supporting member between insulating filaments which extend around the tubular supporting member.

19. A corona charging arrangement comprising:

at least one elongated coronode positioned in spaced relation to the location of a surface to which corona charges are to be applied;

an insulating supporting structure including an insulating member extending along and adjacent to the coronode; and an AC voltage source supplying AC voltage to the coronode, wherein the insulating member comprises a layer of dielectric material coated on the coronode and including a capacitor connected between the AC voltage source and the coronode.

20. A corona charging arrangement according to claim 19 including a conductive shield partially enclosing the coronode.

21. A corona charging arrangement according to claim 20 including a negative DC voltage source connected to the conductive shield.

22. A corona charging arrangement according to claim 21 wherein the negative DC voltage source has a voltage in the range from about 500 volts to 1000 volts.

23. A corona charging arrangement according to claim 19 wherein the layer of dielectric material has a resistivity in the range from about $10^{12}$ ohm-cm to about $10^{14}$ ohm-cm and a thickness in the range from about 0.5 $\mu$m to about 2.0 $\mu$m.

24. A corona charging arrangement according to claim 19 wherein the AC voltage source supplies a voltage in the range from about 5.0 kV to about 7.5 kV.

25. A corona charging arrangement according to claim 19 wherein the capacitor has a capacitance of at least about 50 picofarads.

* * * * *